US008517284B2

(12) United States Patent
Ibrahim et al.

(10) Patent No.: US 8,517,284 B2
(45) Date of Patent: Aug. 27, 2013

(54) SYSTEM AND METHOD FOR INTERNAL COOLING OF A FUEL INJECTOR

(75) Inventors: Daniel R. Ibrahim, Metamora, IL (US); Stephen R. Lewis, Chillicothe, IL (US); Avinash R. Manubolu, Edwards, IL (US)

(73) Assignee: Caterpillar Inc., Peoria, IL (US)

( * ) Notice: Subject to any disclaimer, the term of this patent is extended or adjusted under 35 U.S.C. 154(b) by 279 days.

(21) Appl. No.: 12/465,458

(22) Filed: May 13, 2009

(65) Prior Publication Data

US 2010/0288850 A1 Nov. 18, 2010

(51) Int. Cl.

| | |
|---|---|
| ***B05B 1/24*** | (2006.01) |
| ***B05B 15/00*** | (2006.01) |
| ***B05B 9/00*** | (2006.01) |
| ***B05B 1/30*** | (2006.01) |

(52) U.S. Cl.

USPC ..... 239/132; 239/132.3; 239/125; 239/139; 239/585.5

(58) Field of Classification Search

USPC ..... 239/13, 88–92, 128, 132, 132.3, 239/584–585.5, 125, 132.1, 139; 123/445, 123/446, 447; 417/493, 494; 92/153, 160

See application file for complete search history.

(56) References Cited

U.S. PATENT DOCUMENTS

| | | | | |
|---|---|---|---|---|
| 2,297,421 | A * | 9/1942 | Lorenz | 239/132.3 |
| 2,552,679 | A * | 5/1951 | Hogeman | 239/132.3 |
| 4,094,465 | A * | 6/1978 | Bastenhof | 239/132.3 |
| 4,267,977 | A * | 5/1981 | Stockner et al. | 239/132.3 |
| 4,410,138 | A * | 10/1983 | Peters et al. | 239/95 |
| 4,553,059 | A | 11/1985 | Abe et al. | |
| 4,583,508 | A * | 4/1986 | Schechter | 123/449 |
| 4,958,101 | A | 9/1990 | Takahashi et al. | |
| 5,076,241 | A | 12/1991 | Takahashi et al. | |
| 5,121,730 | A * | 6/1992 | Ausman et al. | 123/467 |
| 6,279,603 | B1 * | 8/2001 | Czarnik et al. | 137/339 |
| 6,296,199 | B1 * | 10/2001 | Noller et al. | 239/533.12 |
| 6,424,078 | B1 | 7/2002 | Heinz | |
| 6,452,308 | B1 | 9/2002 | Heinz et al. | |
| 6,552,472 | B1 | 4/2003 | Heinz | |
| 6,969,009 | B2 * | 11/2005 | Bachmaier et al. | 239/102.2 |
| 7,021,558 | B2 * | 4/2006 | Chenanda et al. | 239/125 |
| 7,175,105 | B2 * | 2/2007 | Plecher et al. | 239/102.2 |
| 7,250,709 | B2 | 7/2007 | Flaemig-Vetter et al. | |
| 7,370,817 | B2 * | 5/2008 | Tilton et al. | 239/585.5 |
| 7,383,794 | B2 * | 6/2008 | Hlousek et al. | 123/41.33 |

(Continued)

FOREIGN PATENT DOCUMENTS

| | | | |
|---|---|---|---|
| DE | 19856202 | A1 | 6/2000 |
| JP | 07-131085 | A | 5/1995 |

*Primary Examiner* — Dinh Q Nguyen
*Assistant Examiner* — Steven M Cernoch
(74) *Attorney, Agent, or Firm* — Leydig, Voit & Mayer

(57) ABSTRACT

A fuel injector includes an injector body forming an actuator portion. An actuator bore is formed in the actuator portion and is at least partially defined by an inner surface and by an end surface. An actuator disposed in the actuator bore and has an outer surface such that a flow channel can be defined between the inner surface of the actuator bore and the outer surface of the actuator. A cooling flow passage is formed in the injector body, in fluid communication with the actuator bore, and is adapted to supply cooling fluid to the actuator bore. A drain passage is formed in the injector body, in fluid communication with the actuator bore. An internal cooling fluid flow path extends from the cooling flow passage, through the flow channel, and from the flow channel through the drain passage.

6 Claims, 9 Drawing Sheets

(56) References Cited

U.S. PATENT DOCUMENTS 7,819,107 B2 * 10/2010 Stockner et al. ..... 123/445
7,849,836 B2 * 12/2010 Chang ..... 123/456
2005/0072863 A1 * 4/2005 Bachmaier et al. ..... 239/584
2006/0124765 A1 * 6/2006 Kothen et al. ..... 239/125
2007/0235556 A1 * 10/2007 Harmon et al. ..... 239/132
2010/0186719 A1 * 7/2010 Venkataraghavan et al. . 123/472

* cited by examiner

SYSTEM AND METHOD FOR INTERNAL COOLING OF A FUEL INJECTOR

TECHNICAL FIELD

This disclosure relates generally to fuel injectors and, more particularly, to cooling arrangements for fuel injectors associated with internal combustion engines.

BACKGROUND

Internal combustion engines having fuel injectors associated with each cylinder are known. A typical fuel injector is positioned beneath the valve cover of the engine and in direct fluid communication with the cylinder. The fuel injector includes various valves and valve arrangements that inject fuel into the cylinder in a controlled fashion. These valves are controlled, typically, by electronic actuators associated with each fuel injector. Each fuel injector is capable of injecting a quantity of fuel into a cylinder of an internal combustion engine at pre-determined times and for pre-determined durations. During operation, electrical signals sent to the electronic actuator are used to control the valve that injects fuel into the cylinder.

Modern engines inject fuel into their cylinders at high pressures. Compression of fuel at a high pressure increases fuel temperature, which in turn increases the temperature within the fuel injector during operation of the engine. The current trend is to increase injection pressures for fuel injected into internal combustion engines. This creates potential thermal issues, which are related to maintaining the temperature of internal components of the fuel injector within pre-determined ranges. Moreover, increased temperatures of the fuel injector, and the injected fuel, tend to increase the oxidization of fuel being injected. This oxidation has the potential to deposit debris on various surfaces of the injector valves.

One known arrangement for providing cooling to a fuel injector can be found in U.S. Pat. No. 4,958,101, granted on Sep. 18, 1990 and assigned on its face to Toyota Jidosha Kabushiki Kaisha, of Japan (the '101 patent). The '101 patent discloses a fuel injector having a piezoactuator associated with a piston. The piston is disposed within a piston bore of a housing and is surrounded by a hollow cylindrical resilient member that applies a compressive load on the actuator. An annular cooling chamber is formed between the piston and the actuator housing. The hollow cylindrical resilient member is inserted into the cooling chamber to bias the piston upward. When a charge is applied to the piezoelectric element, the piezoelectric element expands axially, and as a result, the piston is extended to compress a quantity of fuel to be injected. When the charge of the piezoelectric element is discharged, the piezoelectric element axially contracts, pulling in additional fuel at a supply pressure to be compressed.

Fuel in the annular cooling volume is provided at the same supply pressure as fuel that is injected. When an injection has been completed, additional fuel is pulled into various internal cavities of the fuel injector. The fuel being drawn into various functional volumes of the fuel injector includes fuel coming from the annular cooling volume, which enters a supply passage via a check valve. One disadvantage of mixing cooling fuel with injection fuel is the resulting elevation in the temperature of the injected fuel. For example, heat removed from the piezoactuator of the device disclosed in the '101 patent may increase the temperature of the injected fuel. Moreover, such increase of temperature may further increase the rate of deposit formation on various internal components of the fuel injector.

SUMMARY

In one aspect, this disclosure describes a fuel injector for an internal combustion engine. The fuel injector includes an injector body forming an actuator portion. An actuator bore is formed in the actuator portion and is at least partially defined by an inner surface and by an end surface. An actuator disposed in the actuator bore and has an outer surface such that a flow channel can be defined between the inner surface of the actuator bore and the outer surface of the actuator. A cooling flow passage is formed in the injector body, in fluid communication with the actuator bore, and is adapted to supply cooling fluid to the actuator bore. A drain passage is formed in the injector body, in fluid communication with the actuator bore. An internal cooling fluid flow path extends from the cooling flow passage, through the flow channel, and from the flow channel through the drain passage.

In another aspect, this disclosure describes a machine having an internal combustion engine. The engine includes a crankcase forming a combustion cylinder. A pumping system operates to deliver fuel at a high pressure and fuel at a low pressure, and a drain reservoir receives and collects fuel. A fuel collector volume receives fuel from the pumping system at the high pressure, which fuel is selectively injected into the combustion cylinder via a fuel injector. The fuel injector includes an injection fuel inlet port in fluid communication with the fuel collector volume, a cooling fuel inlet port receiving fuel from the pumping system at the low pressure, and a drain port fluidly connected to the drain reservoir. A cooling path, which is adapted to remove heat from the fuel injector, extends between a low pressure supply port of the pumping system, the cooling fuel inlet port of the fuel injector, the drain port of the fuel injector, and the drain reservoir.

In yet another aspect, this disclosure describes a method of reducing deposits in a fuel injector. In one embodiment, the fuel injector includes a valve actuator in fluid communication with a cooling fuel inlet, a flow passage, and a drain passage formed in the fuel injector. The fuel injector defines a cooling passage that includes the flow passage, which at least partially surrounds the valve actuator. The method of reducing deposits includes passing cooling fuel to the cooling fuel inlet of the fuel injector, the cooling fuel being separate from injection fuel. The cooling fuel is at least partially around the valve actuator through the flow passage. Heat is removed from the valve actuator by absorbing heat from the actuator with the cooling fuel, such that an internal temperature of the fuel injector is maintained below a predetermined debris forming temperature. In this fashion, an amount of deposits forming on internal components of the fuel injector is reduced.

DETAILED DESCRIPTION

The systems and methods described herein provide for cooling of internal components and systems of fuel injectors for internal combustion engines. Such cooling allows for operation of the fuel injectors at increased injection pressures and can further reduce the deposition of debris on the internal components of the fuel injectors.

Figure 1:
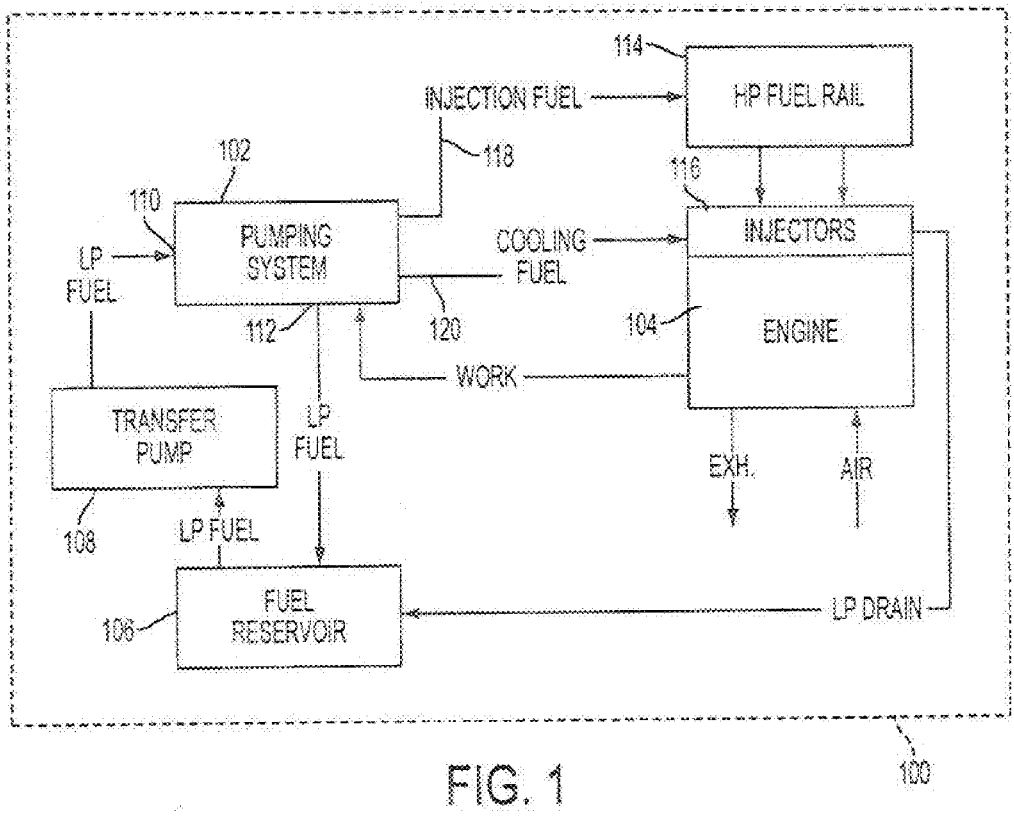
FIG. 1 is a block diagram of a fuel supply system for a machine in accordance with the disclosure.

A block diagram for an engine system 100 having a high-pressure (HP) fuel pumping system 102 operatively associated therewith is shown in FIG. 1. The engine system 100 includes an internal combustion engine 104 connected to the pumping system 102. The engine 104 may be a compression ignition or diesel engine that mixes air and fuel in a plurality of combustion chambers during operation. Fuel at a low-pressure (LP) is supplied to the pumping system 102 from a tank or reservoir 106. A transfer or low-pressure pump 108 disposed adjacent the reservoir operates to pump fuel from the reservoir 106 and supply fuel at a low pressure to the pumping system 102 via a supply inlet port 110. A return outlet port 112 of the pumping system 102 is connected to the reservoir 106 to permit LP fuel exiting the pumping system 102 to return to the reservoir 106.

During operation, the engine 104 provides power to operate the pumping system 102. Such power may be of any appropriate form, for example, electrical, mechanical, and so forth. In one embodiment, the engine 104 provides mechanical power to a rotating shaft that is mechanically connected to an input shaft of one or more pumps within the pumping system 102. In an alternate embodiment, the engine 104 may provide electrical power via an alternator (not shown). The electrical power may be used to operate an electric motor (not shown) that is arranged to operate a pump within the pumping system 102.

During operation, the pumping system 102 provides flow of pressurized injection fuel 118 used for injection into the cylinders of the engine 104. The flow of pressurized injection fuel 118 exits the pumping system 102 and is delivered to the engine 104. In one embodiment, the injection fuel 118 is collected in a HP fuel rail 114 that is connected to a plurality of fuel injectors 116 integrated with the engine 104. A flow of unused fuel from the fuel injectors 116 (LP Drain) may return to the reservoir 106.

The pumping system 102 may further supply an additional flow of fuel, which is denoted as "cooling fuel" 120 in FIG. 1, to the plurality of fuel injectors 116. The cooling fuel 120 may be a fuel flow at a lower pressure than the injection fuel 118, and may further be at a lower temperature. The cooling fuel 120 flow may be provided by the same or a different fuel pump that is part of the pumping system 102. In one embodiment, cooling fuel 20 may first pass through a cooler or other heat exchanger (not shown) before being provided to the plurality of fuel injectors 116.

The cooling fuel 120 convectively cools various components that are internal to each fuel injector in the plurality of fuel injectors 116. Such convective cooling may be accomplished by passing the cooling fuel 120 through internal passages formed within each injector, and contacting the cooling fuel 120 with such components to remove heat therefrom. Having passed through the fuel injectors, the cooling fuel 120 may be collected and combined with the fuel returning to the reservoir 106 (LP Drain).

Figure 2:
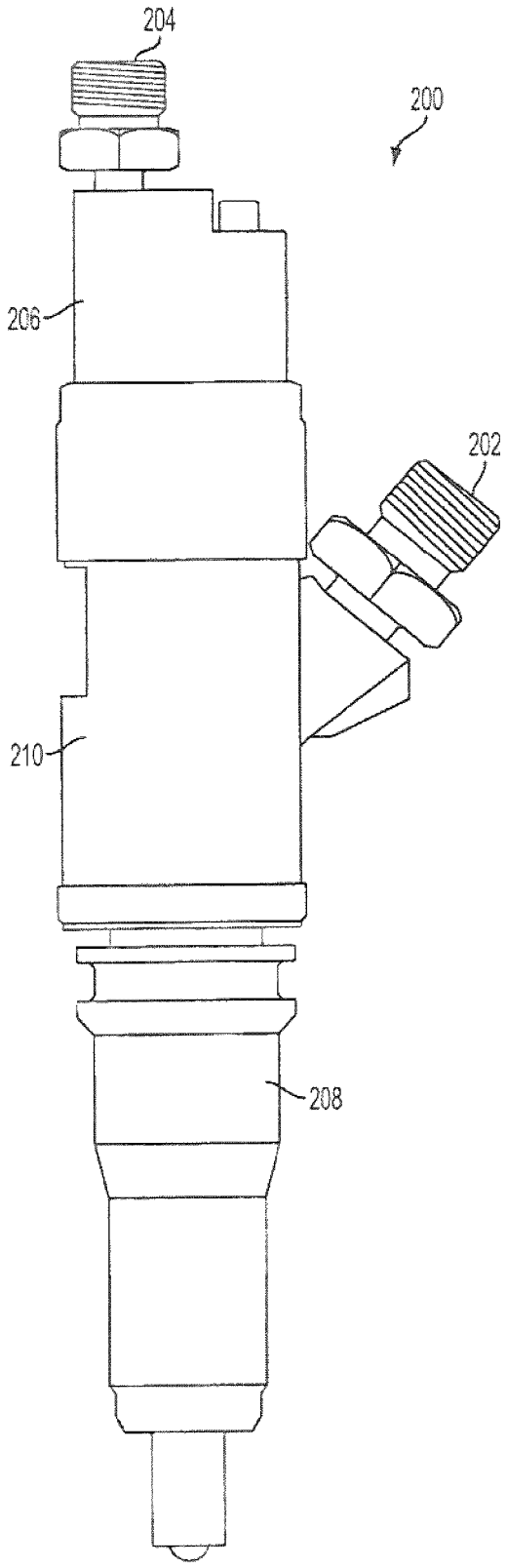
FIG. 2 is an outline view of a fuel injector having an injection fuel inlet port and a cooling fuel inlet port in accordance with the disclosure.

FIG. 2 is a side view of a fuel injector 200. The fuel injector 200 includes an injection fuel inlet port 202 and a cooling fuel inlet port 204. The fuel injector 200 may be one of the plurality of fuel injectors 116 diagrammatically shown in FIG. 1. The injection fuel inlet port 202 is connected to a high-pressure fuel system (not shown) that provides pressurized fuel from the HP fuel rail 114. The HP fuel is injected into a cylinder (not shown) of the engine 104. In a similar fashion, the cooling fuel inlet port 204 is connected to a respective fluid conduit (not shown) that provides the cooling fuel 120 flow thereto.

The fuel injector 200 includes an actuator portion 206, which houses an actuator (not shown). The actuator operates to selectively urge a needle valve (not shown), disposed in a needle portion 208 of the fuel injector 200, to open and closed positions. Such motion of the needle valve permits controlled amounts of pressurized fuel from the injection fuel inlet port 202 to be injected through orifices (not shown) formed proximate to the tip of the needle portion 208 to be injected into the cylinder of the engine. The fuel injector 200 further includes a body portion 210 disposed between the actuator portion 206 and the needle portion 208. As is described below, various passages and cavities that route various flows of fuel to and from various internal components of the fuel injector 200 are formed in the body portion 210.

Figure 3:
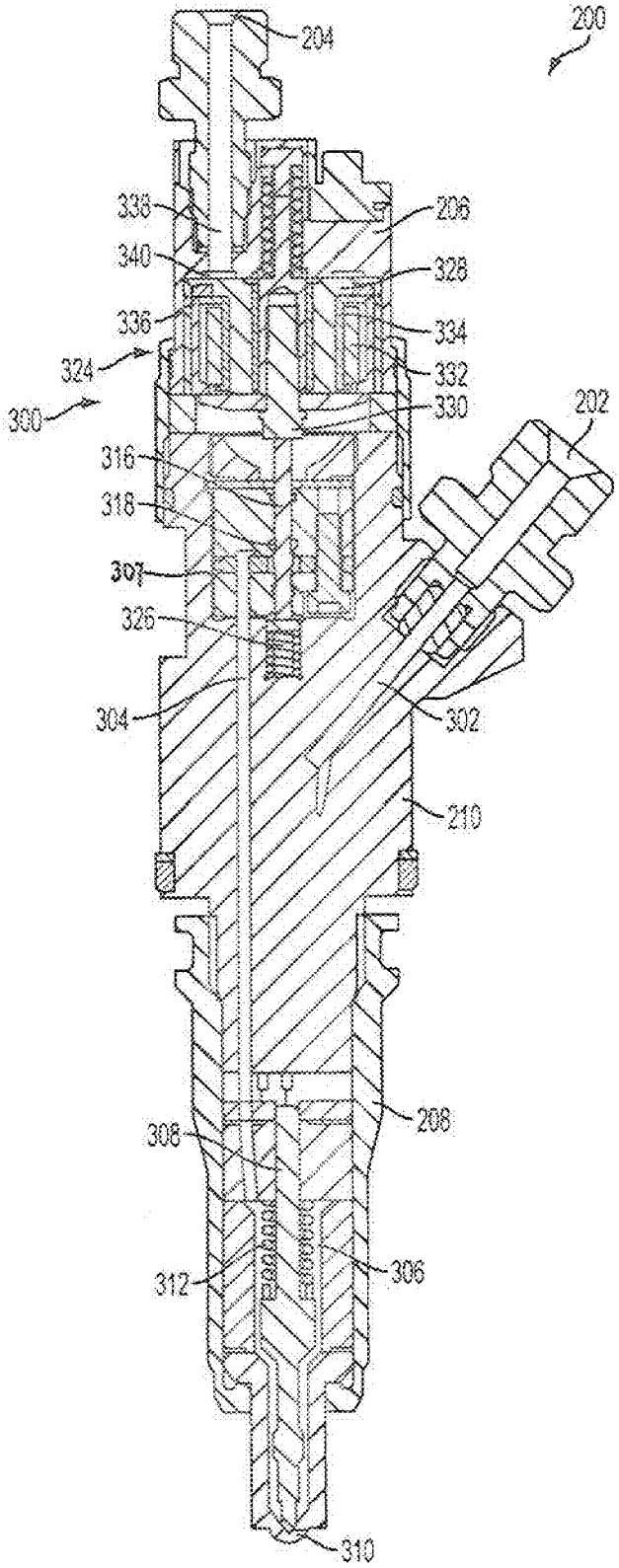
FIG. 3 is a cross section of the fuel injector shown in FIG. 2.
Figure 4:
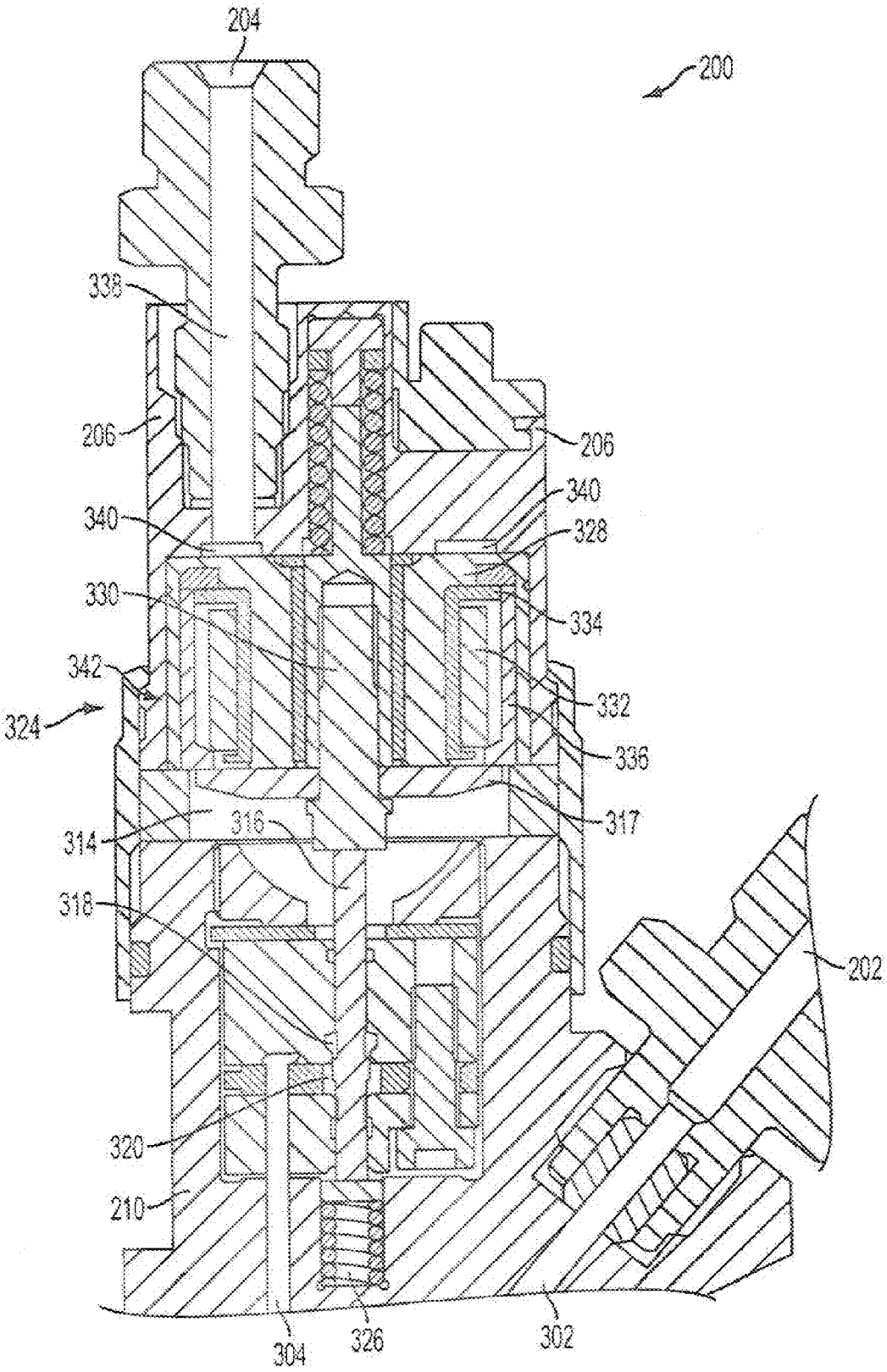
FIG. 4 is an enlarged detail view of the cross section shown in FIG. 3.

In the description that follows, elements already described are denoted by the same reference numerals as previously used. A cross section through the fuel injector 200 is shown in FIG. 3. FIG. 4 shows an enlarged partial view of fuel injector 200, which better illustrates various internal components thereof and should be considered in conjunction with FIG. 3. The body portion 210 of the fuel injector 200 forms a fuel supply passage 302 that fluidly communicates with the fuel inlet port 202. An injection supply passage 304, formed through the body portion 210, extends between a three-port two-position (3-2) valve 300 and a needle cavity 306. The 3-2 valve 300 is disposed within a cavity 307 formed in the body portion 210. When actuated, the 3-2 valve 300 selectively ports high-pressure fuel from the fuel supply passage 302 to the injection supply passage 304. The needle cavity 306 is a chamber formed in the needle portion 208 that houses a needle valve 308.

The needle valve 308 is adapted for reciprocal movement within the needle cavity 306 such that when extended the needle valve 308 fluidly blocks the one or more nozzle openings 310 that are formed at an end or tip of the needle portion 208. When not activated, a tension spring 312 urges the needle valve 308 toward a closed position. When the 3-2 valve 300 is activated and provides fuel at a high pressure to the needle cavity 306, the needle valve 308 is urged by a pressure differential caused by the high-pressure fluid present in the needle cavity 306 to the open position. Opening of the needle valve 308 permits fuel to exit the needle cavity 306 through the one or more nozzle openings 310 and be injected into a cylinder of the engine 104 (FIG. 1). Unused fuel or fuel that has not been injected from the needle cavity 306 is routed to a drain passage 314 when the 3-2 valve 300 is not activated.

The 3-2 valve 300 includes a poppet rod 316 that is connected to a main poppet 317. The poppet rod 316 reciprocates to selectively connect an injection port 318 with a supply port 320 when the poppet rod 316 is in an activated or extended position. The poppet rod 316 permits connection between the injection port 318 and the drain passage 314 when the poppet rod 316 is in a deactivated or retracted position. The injection port 318 is fluidly connected to the injection supply passage 304, and the supply port 320 is fluidly connected to the fuel supply passage 302. Motion of the poppet rod 316 is accomplished by an actuator 324. When the actuator 324 is not activated, a return spring 326 urges the poppet rod 316 to the retracted position. The actuator 324 urges the poppet rod 316 in the opposite direction, that is, against the return spring 326, when activated.

In one embodiment, the actuator 324 is an electromagnetic actuator that includes a spool solenoid 328 surrounding a core 330. The spool solenoid 328 has a wire spool 332 that is wound around a bobbin 334 and covered by a shroud 336. Current passing through the wire spool 332 activates the actuator 324 and creates a magnetic field that moves the core 330. The core 330 is disposed in contacting relation with an end of the poppet rod 316 such that movement of the core 330 relative to the actuator 324 causes movement of the poppet rod 316. In an alternative embodiment, the actuator 324 includes a stack of piezoelectric elements (not shown) used to create the force that moves the poppet rod 316. Irrespective of the particular arrangement of the actuator 324, electrical current passing therethrough generates heat within the actuator 324. Moreover, heat generated by friction between various components of the actuator 324 may further increase the temperature of the actuator 324.

A flow of fuel entering the fuel injector 200 through the cooling fuel inlet port 204 passes over portions of the actuator 324 to convectively remove heat therefrom and aid in maintaining a lower temperature of the actuator 324. The cooling fuel inlet port 204 is fluidly connected to a cooling fuel passage 338 that is formed in the actuator portion 206. The cooling fuel passage 338 routes fuel from the cooling fuel inlet port 204 into a distribution chamber 340, which is partially shown in the cross sections of FIG. 3 and FIG. 4. The distribution chamber 340 is a cavity formed in the actuator portion 206 of the fuel injector 200. Fuel from the cooling fuel inlet port 206 is distributed around the actuator 324. In one embodiment, the distribution chamber 340 is an annular cavity that extends at least partially around an interface defined by a surface of the actuator portion 206 and a mating surface of the actuator 324.

Figure 6:
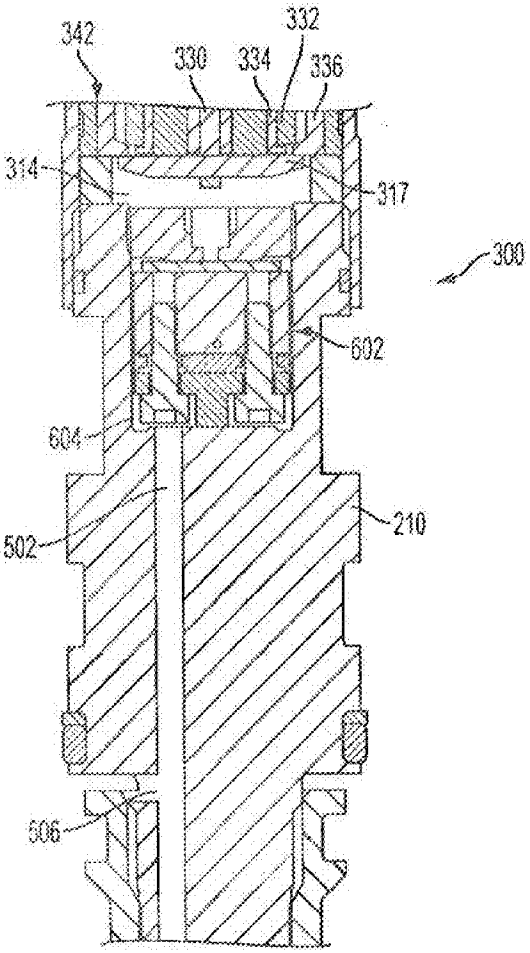
FIG. 5 and FIG. 6 are cross section detail views of fuel injectors in accordance with the disclosure.
Figure 5:
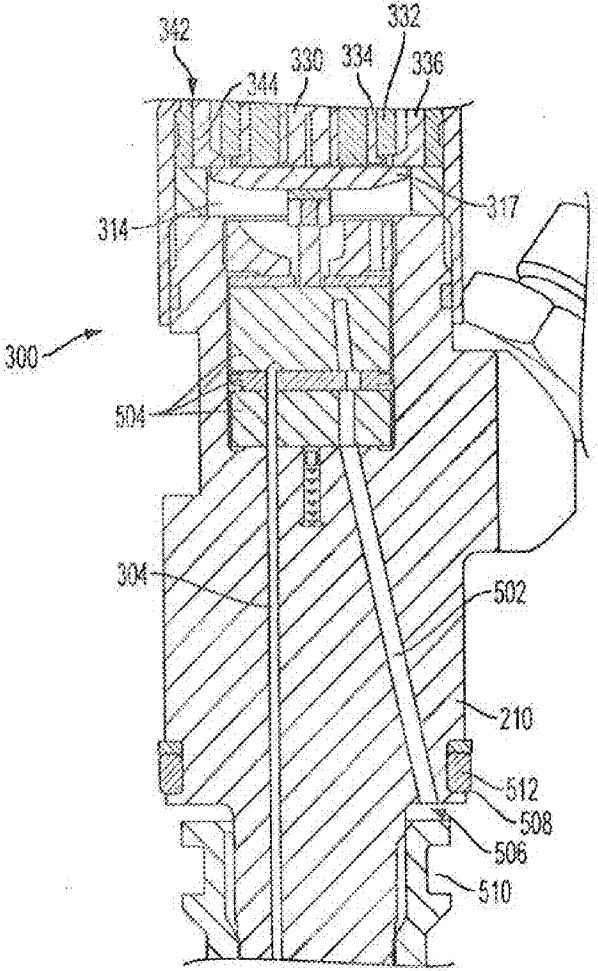

Two cross sections of two alternative embodiments for the fuel injector are shown in FIG. 5 and FIG. 6 to illustrate various internal fluid passages thereof. As above, elements having the same or similar characteristics as elements previously described, for example, relative to FIG. 3 and FIG. 4, are denoted by the same reference numerals as previously used.

In the embodiment shown in FIG. 5, the fuel injector 200 forms a drainage passage 502 that extends through the body portion 210. The drainage passage 502, in this embodiment, extends axially through a multi-piece housing 504 of the 3-2 valve 300 and is in fluid connection with the drain passage 314 (connection not visible). The drainage passage 502 terminates at a drain opening 506, disposed between a first seal groove 508 and a second seal groove 510. A seal 512 is disposed within the first seal groove 508. When the fuel injector 200 is installed into an engine component (not shown), the drain opening is located between the seal 512 and an additional seal (not shown) disposed within the second seal groove 510 to isolate the opening from the environment. At the same time, the opening is in fluid communication with a drain passage (not shown) that is formed in the engine component and is fluidly connected to the fuel reservoir 106 (FIG. 1). Hence, fluid from the drain passage 314 flows from the fuel injector 200 via the drain opening 506, through the drain passage in the engine component, and returns to the fuel reservoir 106.

When the fuel injector 200 operates, cooling fuel is provided through the cooling fuel passage 338 in the actuator portion 206, as previously described and illustrated in FIG. 3 and FIG. 4. The cooling fuel is distributed around the distribution chamber 340 and enters an annular actuator cooling passage 342 that substantially surrounds the actuator 324. This passage 342 is formed, at least partially, between the actuator 324 and an inner surface or surfaces 344 of the actuator portion 206. In one embodiment, the actuator portion 206 forms an internal, cylindrical cavity 346, which surrounds the actuator 324.

The flow of cooling fuel passing through the annular actuator cooling passage 342 removes heat from the actuator 324 by conduction and/or convection. The cooling fuel then collects in the drain passage 314 and drains out of the fuel injector 200 as previously described. In one embodiment, as shown in FIG. 6, the fuel injector 200 may form a secondary annular cooling passage 602 around a portion of the multi-piece housing 504 of the 3-2 valve 300. The secondary annular cooling passage 602 may permit at least a portion of the cooling fuel or other fuel having collected in the drain passage 314 to pass over and provide additional cooling to the multi-piece housing 504 of the 3-2 valve 300. Such additional flow of fuel may collect in a secondary drain collector cavity 604 that is formed within the fuel injector 200 between the 3-2 valve 300 and the body portion 210. The secondary drain collector cavity 604 fluidly communicates with the drainage passage 502 such that fuel found therein during operation may drain out of the fuel injector 200 via the drain opening 506.

Figure 7:
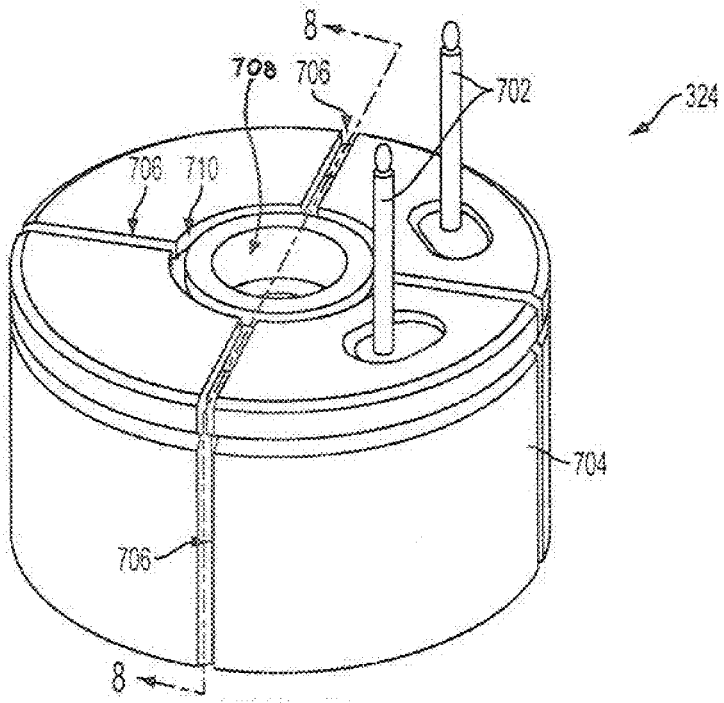
FIG. 7 is an outline view and FIG. 8 is a cross section of an actuator for a fuel injector in accordance with the disclosure.
Figure 8:
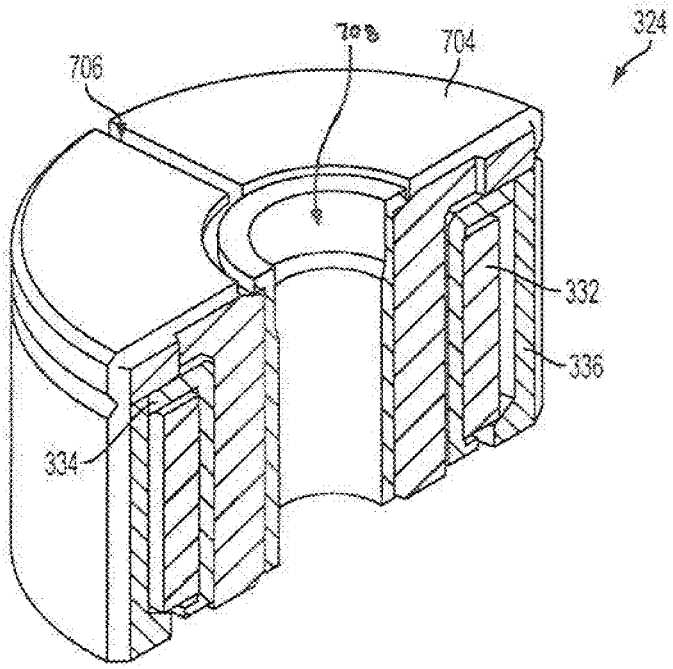

An outline view of one embodiment of the actuator 324 is shown in FIG. 7, with a section view thereof taken through line 8-8 shown in FIG. 8. In this embodiment, the actuator 324 includes two electrical leads 702 that are electrically connected to an arrangement (not shown) that electrically energizes the wire spool 332. The two electrical leads 702 extend from a surface of the actuator 324 and protrude past a segmented jacket 704. The segmented jacket 704 substantially surrounds the actuator 324 and, in this embodiment, is integrated therewith to contain the various components of the actuator 324 into a modular design, and to provide a protective casing therefor.

The segmented jacket 704 forms one or more cooling channels 706 that extend along the outer surface of the actuator 324. In the embodiment shown in FIG. 7 and FIG. 8 there are four such cooling channels 706 that extend radially away from a central opening 708 of the actuator 324. The cooling channels 706 further extend axially along the sides of the actuator 324, and are fluidly interconnected to one another by an annular channel 710 that is formed in the segmented jacket 704 and that surrounds the central opening 708.

In one embodiment, the cooling fuel passes through the one or more cooling channels 706 when flowing between the cooling fuel passage 338 (FIG. 4) and the drain passage 314 (FIG. 4). In one embodiment, the cooling channels 706 extend through the entire segmented jacket 704 along portions thereof such that direct contact may be provided between components of the actuator 324 and the cooling fuel passing through the cooling channels 706. Moreover, in one embodiment, the segmented jacket 704 may be made of a thermally conductive material such that heat may be conductively removed from the actuator 324 by the segmented jacket 704, which can then be convectively cooled by the cooling fuel passing over and/or through the segmented jacket 704, for example, by flowing through the one or more cooling channels 706.

Figure 9:
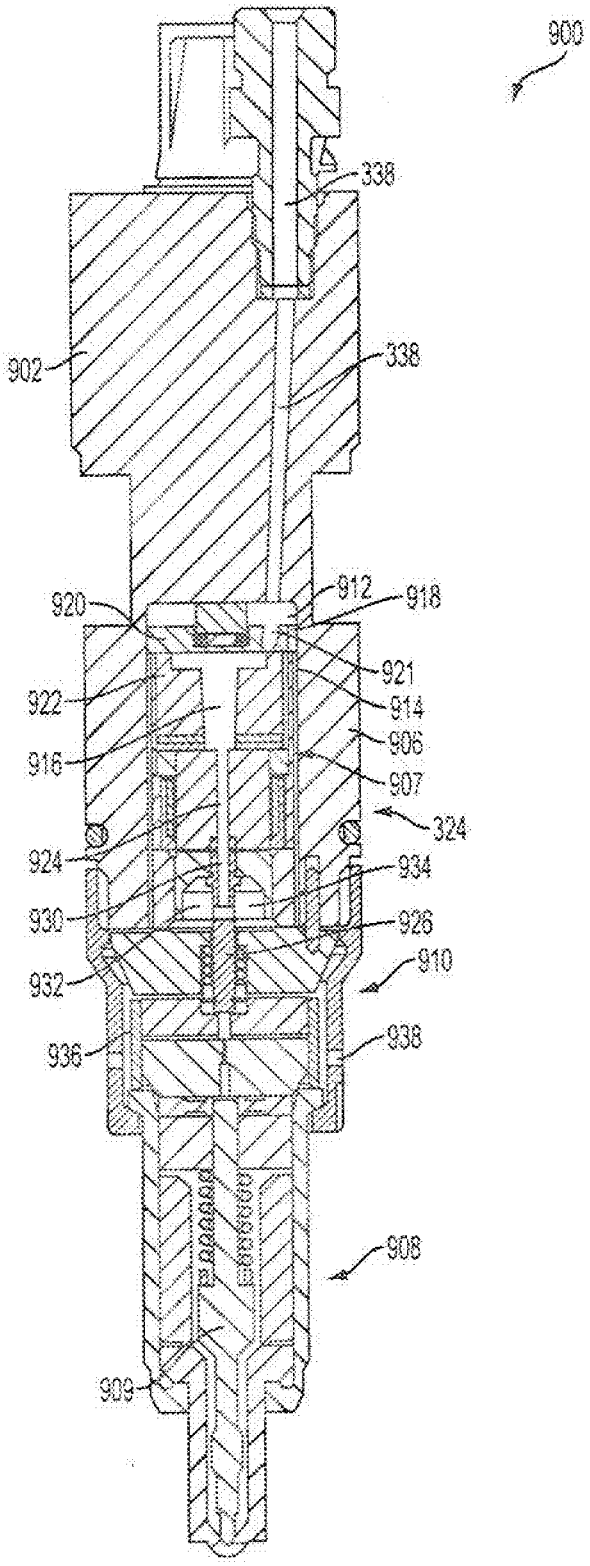
FIG. 9 is a cross section of an alternative embodiment for a fuel injector having an internal cooling arrangement in accordance with the disclosure.
Figure 10:
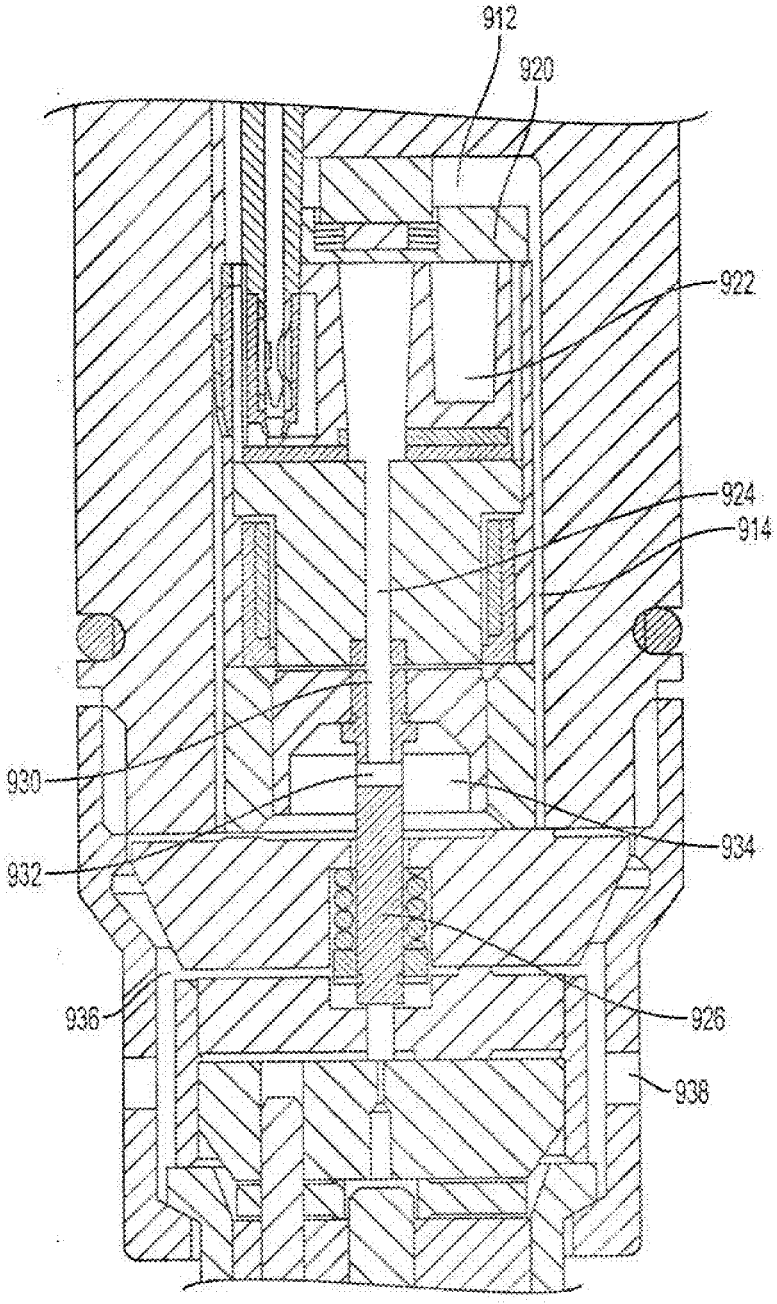
FIG. 10 is an enlarged detail view of the cross section shown in FIG. 9.

A cross section of an alternative embodiment of a fuel injector 900 is shown in FIG. 9, with a detail view thereof shown in FIG. 10. As previously, like or similar elements as previously described are denoted by the same reference numerals as previously used for simplicity. The fuel injector 900 includes an extended upper portion 902 that forms a segment of the cooling fuel passage 338. An actuator portion 906 forms a cavity 907 that encloses the actuator 324. A needle portion 908 houses a hydraulically balanced needle valve 909, while various other internal components of the fuel injector 900 are housed within a body portion 910 thereof.

The fuel injector 900 may operate in the same or similar manner as the fuel injector 200. For example, the fuel injector 900 may embody pressure amplification or intensification features. The fuel injector 900 includes an internal fuel cooling passage having additional functionality when compared to the embodiment for a fuel cooling arrangement described relative to the fuel injector 200 shown and described above, in that the fuel injector 900 includes passages capable of providing internal as well as external cooling to the actuator 324.

More specifically, the fuel injector 900 is arranged for routing a flow of cooling fluid, for example, fuel, not only around the actuator 324, but also through the actuator 324 to promote improved cooling thereof. The cooling fuel passage 338 in this embodiment is connected to a cavity or manifold 912 that collects cooling fuel during operation. The cooling fuel collected in the manifold 912 is distributed such that internal and external cooling of the actuator within the fuel injector 900 may be accomplished. A portion of the cooling fluid from the manifold 912 is routed to an annular cooling passage 914, and a remaining portion is routed to a central cooling supply passage 916.

The annular cooling passage 914 is connected to the manifold 912 via an opening 918 formed in a spacer plate 920. The spacer plate 920 is a cylindrical plate separating the actuator 324 from the manifold 912. The spacer plate 920 forms the opening 918, which extends therethrough, and may form additional openings that fluidly connect the manifold 912 with the annular cavity 907 such that the portion of cooling fuel may enter the cavity 907 and pass over or wet the external surfaces of the actuator 324.

The spacer plate 920 forms an additional opening 921, which fluidly connects the manifold 912 with a central cooling supply passage 916 such that the remaining portion of the cooling fuel may enter and pass through a central portion of the actuator 324. In one embodiment, the actuator 324 is a solenoid 922. The solenoid 922 forms a core opening 924 that accepts a moveable core 926. The moveable core 926 forms a bore 930 that centrally extends along a centerline of the moveable core 926 to provide a flow-path for the remaining portion of the cooling fuel. In the embodiment shown, the solenoid 922 forms a funnel-shaped opening at an end thereof that is adjacent to the spacer plate 920 to facilitate the flow of fuel entering the central cooling supply passage 916.

The portion of the fluid flow fuel passing through the solenoid 922 enters the bore 930 of the moveable core 926 via an opening formed at an end thereof. The fuel then travels within the bore 930 over a portion of the moveable core 926 before exiting the moveable core 926 through a cross-drilled hole or cross-opening 932 that is formed in the moveable core 926 and that communicates with the bore 930. The cross-opening 932 in the embodiment shown extends perpendicularly relative to the bore 930.

The cooling fuel passing around and through the solenoid 922 is collected in a drain passage 934 that is formed in the fuel injector 900. The drain passage 934 fluidly communicates with a drain 936 having one or more drain openings 938 that allow fuel to drain out from the fuel injector 900 and return to the reservoir as previously described. During operation, cooling fuel may continuously flow through the fuel injector at a constant or, in one embodiment, at a variable rate that depends on the pressure of fuel at the outlet of the fuel pumping system 102. As can be appreciated, operation of the fuel injector 900 at an increasing degree may generate higher injection pressures and increased cycling of the actuators within, thus increasing the heat that should be removed. Such increased heat may be sufficiently removed from the fuel injector when coupled with the increased flow of fuel passing therethrough.

In the embodiments described thus far, the annular actuator cooling passage 342 (FIG. 4) and the annular cooling passage 914 (FIG. 9) are formed at the interface between an outer surface of the respective actuator and an inner surface of the body of the fuel injector. Such cooling passages provide a flow path for fuel that cools the actuator of a fuel injector externally. The flow area of such passages may be augmented, and the convective cooling provided may be increased, such that the overall cooling effect of the flow of fuel passing therethrough may be improved. Three alternative embodiments of fuel injector actuator housings or components of the actuator portion for a fuel injector are shown in the outline views of FIG. 11-13.

Figure 11:
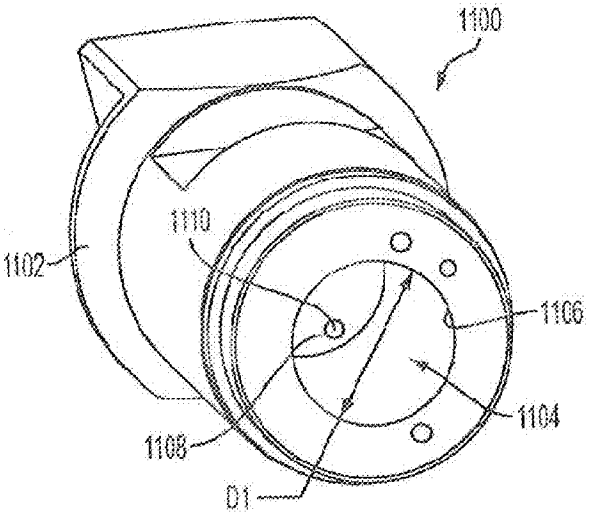

One embodiment of an actuator housing 1100 is shown in FIG. 11. A cylindrical housing 1102 is shown in this and in the embodiments that follow, but it should be appreciated that the general shape of an actuator housing may be different for different fuel injector designs. Thus, the specific design attributes of the embodiments presented should not be construed as limiting to the scope of the description or the appended claims. The cylindrical housing 1102 forms an actuator bore 1104 that is adapted to at least partially enclose an actuator, for example, a solenoid or piezoelectric actuator, for a fuel injector. The actuator bore 1104 is laterally defined by a cylindrical inner surface 1106. At one end, the actuator bore 1104 terminates at a circular surface 1108. When the actuator housing 1100 is assembled into a fuel injector, an actuator having a generally cylindrical shape is inserted into the actuator bore 1104. A cooling fuel supply opening 1110 is formed in the circular surface 1108. The cooling fuel supply opening 1110 extends through the actuator housing 1100 and is fluidly connected to a supply of cooling fuel (not shown) such that cooling fuel may enter the internal volume of the actuator bore 1104 and cool the actuator disposed therein.

In one embodiment, an internal diameter, D1, of the actuator bore 1104 is oversized to provide a clearance fit between the actuator housing 1100 and the actuator (not shown) that is disposed therein. In such embodiment, additional features may be used to align the actuator within the actuator bore 1104 and provide a substantially uniform flow area for the annular flow passage that results therebetween when the fuel injector is assembled. Moreover, even though one cooling fuel supply opening 1110 is shown, more openings may be formed to facilitate entry of cooling fuel into the actuator bore 1104.

Figure 12:
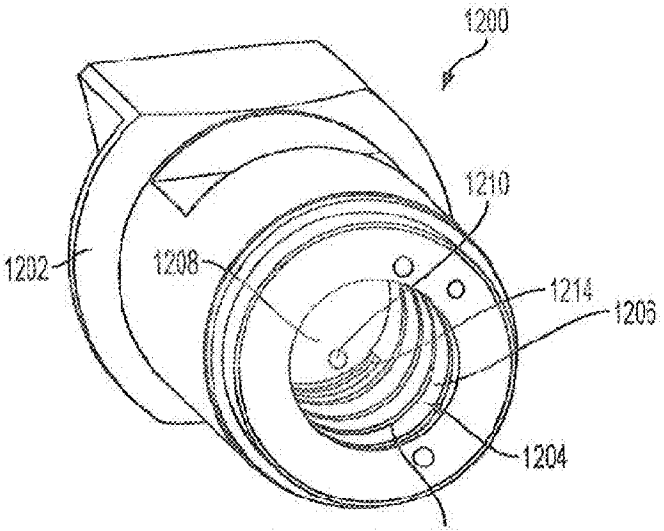
FIGS. 11-13 are outline views of alternative embodiments for actuator housings for use with fuel injectors in accordance with the disclosure.

An alternative embodiment for an actuator housing 1200 is shown in FIG. 12. The actuator housing 1200 includes a cylindrical housing 1202 that forms an actuator bore 1204. The actuator bore 1204 is defined by a cylindrical inner surface 1206 and a circular surface 1208, which further forms a cooling fuel supply opening 1210. In this embodiment, a spiral channel 1212 is formed on an inner side of the actuator bore 1204 along the cylindrical inner surface 1206. More particularly, the spiral channel 1212 is formed peripherally around the actuator bore 1204 to provide a flow path for cooling fuel entering the actuator bore 1204 during operation from the cooling fuel supply opening 1210.

The spiral channel 1212 has an inlet portion 1214 disposed close to the circular surface 1208 adjacent to the cooling fuel supply opening 1210. When fuel enters the actuator bore 1204 during operation, a portion of the flow of fuel may enter the spiral channel 1212 via the inlet portion 1214 and follow a spiraling path around the actuator disposed within the actuator bore 1204, thus increasing the time and area of contact between cooling fuel and the actuator to improve the heat transfer therebetween. In the embodiment shown, the spiral channel 1212 has a triangular cross section, but other cross sectional shapes can be used, for example, rectangular, trapezoidal, semi-circular, and others.

Figure 13:
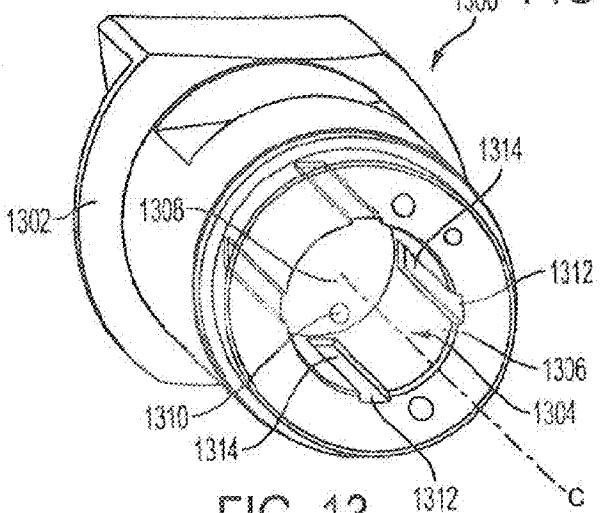

An additional alternative embodiment for an actuator housing 1300 is shown in FIG. 13. As in the two previously described embodiments, the actuator housing 1300 includes a cylindrical housing 1302 that forms an actuator bore 1304. The actuator bore 1304 is at least partially defined in a radial direction by a cylindrical inner surface 1306, and in an axial direction by a circular surface 1308. In this embodiment, the spiral channel 1212 is replaced by a plurality of straight channels 1312, each of which extend axially along the actuator bore 1304. The plurality of straight channels 1312 is formed in the cylindrical inner surface 1306. In the embodiment shown, four channels make up the plurality of straight channels 1312. Each of the four channels is formed in the cylindrical inner surface 1306 and extends parallel to a centerline C of the actuator bore 1304, even though each channel may alternatively be disposed at an angle relative to other channels and/or the centerline C.

Each of the plurality of straight channels 1312 has an inlet portion 1314 defined adjacent to the circular surface 1308. Similar to the two previously described embodiments, a cooling fuel supply opening 1310 is formed in the circular surface 1308. During operation, a flow of cooling fuel enters the actuator bore 1304 via the cooling fuel supply opening 1310 and wets the actuator (not shown) disposed therein. The plurality of straight channels 1312 increase the cross sectional area around the actuator disposed in the actuator bore 1304 for the cooling fuel to pass through, thus decreasing the pressure drop across that portion of the fuel injector and increasing the flow rate of cooling fuel, which also increases the rate of heat removal therefrom.

In one embodiment, the actuator 324 made in accordance with the embodiment shown in FIG. 7 and FIG. 8 may be used in conjunction with the actuator housing 1300. In such a combination, the one or more cooling channels 706 (FIG. 7) may be oriented to coincide with respective straight channels 1312 formed in the actuator bore 1304 such that the flow area for cooling fuel to pass therethrough is even further increased, thus increasing the rate of heat removal from the actuator 324.

INDUSTRIAL APPLICABILITY

The present disclosure is applicable to fuel injectors for internal combustion engines, and especially for internal combustion engines operating at relatively high injection fuel pressures. In one embodiment, a pumping system for an engine can be adapted to provide an additional source of fuel. This additional source of fuel may yield a flow of cooling fuel for cooling fuel injectors associated with the engine in accordance with the present disclosure. Further, a machine or vehicle associated with the engine may include an additional or secondary fuel cooling arrangement, which can decrease the temperature of the cooling fuel before supplying the same to cool the fuel injectors of the engine. In one embodiment, the temperature of electronic components within the fuel injector is maintained below 130 deg. C. New and/or existing engines and machines or vehicles may benefit from the fuel cooling arrangements described herein.

One additional effect of increasing the injection pressure of fuel in an engine, thus increasing the temperature of the fuel being injected, is the formation of debris on internal components of the fuel injector. Such debris may be the result of deposition of heavier compounds found in the fuel, which deposit when lighter compounds are evaporated at the higher fuel temperatures. It has been found that effective internal cooling of the fuel injector as described herein reduces the accumulation of heavier fuel compounds onto internal components of the fuel injector, which in turn preserves the optimal performance of the fuel injector for longer periods. Any degree of internal cooling of a fuel injector may advantageously reduce the accumulation of debris onto internal components thereof.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

We claim:

1. A fuel injector for an internal combustion engine, comprising:

an injector body forming an actuator portion;

an actuator bore formed in the actuator portion, the actuator bore at least partially defined by an inner surface and by an end surface;

an electrical actuator disposed in the actuator bore and having an outer surface;

a flow channel defined between the inner surface of the actuator bore and the outer surface of the electrical actuator;

a cooling flow passage formed in the injector body in fluid communication with the actuator bore and adapted to supply cooling fluid to the actuator bore;

a drain passage formed in the injector body in fluid communication with the actuator bore;

an internal cooling fluid flow path extending from the cooling flow passage, through the flow channel, and from the flow channel through the drain passage; and a plurality of channels formed in the injector body along the inner surface, wherein a cooling fluid opening is formed in the end surface to fluidly connect the actuator bore with the cooling flow passage, and wherein an inlet portion of each of the plurality of channels is disposed adjacent to the cooling fluid opening.

2. The fuel injector of claim 1, wherein each of the plurality of channels extends parallel to a centerline of the actuator bore.

3. A fuel injector for an internal combustion engine, comprising:

an injector body forming an actuator portion;

an actuator bore formed in the actuator portion, the actuator bore at least partially defined by an inner surface and by an end surface;

an electrical actuator disposed in the actuator bore and having an outer surface;

a flow channel defined between the inner surface of the actuator bore and the outer surface of the electrical actuator;

a cooling flow passage formed in the injector body in fluid communication with the actuator bore and adapted to supply cooling fluid to the actuator bore;

a drain passage formed in the injector body in fluid communication with the actuator bore; and an internal cooling fluid flow path extending from the cooling flow passage, through the flow channel, and from the flow channel through the drain passage;

wherein the electrical actuator further includes a segmented jacket forming one or more cooling channels, each of the one or more cooling channels extending along the outer surface of the electrical actuator.

4. The fuel injector of claim 3, wherein the one or more cooling channels include four cooling channels, each of the four cooling channels extending away from a central opening adjacent to the end surface, and along a lateral surface of the electrical actuator adjacent to the inner surface of the actuator bore.

5. A fuel injector for an internal combustion engine, comprising:

an injector body forming an actuator portion;

an actuator bore formed in the actuator portion, the actuator bore at least partially defined by an inner surface and by an end surface;

an electrical actuator disposed in the actuator bore and having an outer surface;

a flow channel defined between the inner surface of the actuator bore and the outer surface of the electrical actuator;

a cooling flow passage formed in the injector body in fluid communication with the actuator bore and adapted to supply cooling fluid to the actuator bore;

a drain passage formed in the injector body in fluid communication with the actuator bore;

an internal cooling fluid flow path extending from the cooling flow passage, through the flow channel, and from the flow channel through the drain passage;

a central bore formed in the electrical actuator;

a moveable core forming a central flow passage disposed within the central bore of the electrical actuator;

wherein the internal flow path defined within the fuel injector further includes the central bore and the central flow passage, and wherein the internal flow path and the central flow passage are adapted to permit a portion of a cooling flow of fluid to flow therein in parallel with a remaining portion of the cooling flow of fluid to flow through the flow channel.

6. The fuel injector of claim 5, further including a spiral channel formed in the injector body along the inner surface, wherein a cooling fluid opening is formed in the end surface to fluidly connect the electrical actuator bore with the cooling flow passage, and wherein an inlet portion of the spiral channel is disposed adjacent to the cooling fluid opening.

* * * * *